US006778037B1

(12) United States Patent
Salmela et al.

(10) Patent No.: US 6,778,037 B1
(45) Date of Patent: Aug. 17, 2004

(54) MEANS FOR HANDLING HIGH-FREQUENCY ENERGY

(75) Inventors: Olli Salmela, Helsinki (FI); Esa Kemppinen, Helsinki (FI); Markku Koivisto, Espoo (FI); Hans Somerma, Veikkola (FI); Pertti Ikäläinen, Huhmari (FI); Petri Savolainen, Espoo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/009,273

(22) PCT Filed: Jun. 9, 2000

(86) PCT No.: PCT/FI00/00524

§ 371 (c)(1),
(2), (4) Date: Apr. 2, 2002

(87) PCT Pub. No.: WO00/77880

PCT Pub. Date: Dec. 21, 2000

(30) Foreign Application Priority Data

Jun. 11, 1999 (FI) ..... 991341

(51) Int. Cl.[7] ..... H01P 3/08
(52) U.S. Cl. ..... 333/109; 333/116; 333/128
(58) Field of Search ..... 333/101, 103, 333/108, 109, 112, 114, 116, 124–128, 100

(56) References Cited

U.S. PATENT DOCUMENTS

| | | | | |
|---|---|---|---|---|
| 5,745,017 A | | 4/1998 | Ralph | 333/116 |
| 5,821,836 A | * | 10/1998 | Katehi et al. | 333/202 |
| 6,170,154 B1 | * | 1/2001 | Swarup | 333/177 |

FOREIGN PATENT DOCUMENTS

| | | |
|---|---|---|
| JP | 4139896 | 5/1992 |
| JP | 11068261 | 3/1999 |
| JP | 11136012 | 5/1999 |

OTHER PUBLICATIONS

T. Tokoumitsu et al., "Multilayer MMIC Using a 3μm x 3 layer Dielectric Structure;" IEEE MTT–S Digest pp. 831–834.

S.P. Marsh, "MMIC Power Splitting and Combining Techiques"; 1997 The Institution of Electrical Engineers, pp. 6/1–6/7.

K. Nishikawa et al., "Miniaturized Wilkinson Power Divider Using Three–Dimensional MMIC Technology", IEEE Microwave and Guided Wave Letters, vol. 6, No. 10, Oct. 1996, pp. 372–374.

* cited by examiner

*Primary Examiner*—Kenneth B. Wells
(74) *Attorney, Agent, or Firm*—Cohen, Pontani, Lieberman & Pavane

(57) ABSTRACT

The invention relates to structures, by which part of the incoming high-frequency energy can be separated to its own path (out1) or energies coming from different paths can be combined to a common path. The basic idea of the invention is that all components of the dividing or combining means are integrated into a monolithic structure in an insulating material, preferably multilayer ceramics. The transmission line strips (311) and other conductors are formed by printing conductive material on the outer surface of the ceramic piece (301) and in its interlayers, when required. The conductors between the surfaces are formed by filling the hole made through the layer or layers with conductive material. The resistive components (321) parallel with and between the surfaces are formed in a similar manner. The structure according to the invention is relatively small and reliable, and its manufacturing costs are low.

11 Claims, 3 Drawing Sheets

MEANS FOR HANDLING HIGH-FREQUENCY ENERGY

PRIORITY CLAIM

This is a U.S. national stage of application No. PCT/FI00/00524, filed on Jun. 09, 2000. Priority is claimed on that application and on the following application: Country: Finland, Application No.: 991341, Filed: Jun. 11, 1999.

FIELD OF THE INVENTION

The present invention relates to structures, by which part of the incoming high-frequency energy can be separated to its own path or energies coming from different paths can be combined to a common path. Means like this are needed in units connected to the base station antennas of mobile networks, for example.

BACKGROUND OF THE INVENTION

High-frequency dividing means include power dividers and directional couplers. In a power divider, the incoming energy is divided to two or more output paths so that the powers of the branches are usually equally high. A common divider type is the Wilkinson divider, by which the energy can be divided to several output paths as matched and with relatively small losses. The directional coupler has four ports: The energy coming to the input port is mostly directed to a second port, a relatively small part of the incoming energy is directed to the third port, and hardly any energy goes to the fourth port.

In practice, the dividing means are mostly realized by using microstrips. FIG. 1 shows an example of such a prior art structure. This is a four-branch Wilkinson divider, which is manufactured in an ordinary circuit board. The circuit board includes a dielectric board 101, on the lower surface thereof a conductor plane 102 connected to the signal ground, and on the upper surface a microstrip 103. The characteristic impedance of the transmission line formed by these parts is $Z_o$, which is the same as the impedance of the feed line of the structure. The strip 103 is branched into four microstrips 111, 112, 113 and 114. Their length is $\lambda/4$ at the operating frequency, and each of them forms an impedance $Z_o/\sqrt{4}=Z_o/2$ with the board 101 and the ground plane 102. A discrete resistor 121, the resistance of which is $Z_o$, is connected to the second end of the microstrip 111. Correspondingly, similar resistors 122, 123 and 124 are connected to the second ends of the strips 112, 113 and 114, respectively. The second ends of the resistors are connected together with a conductor 105, which consists of three jumper wires. If a multilayer board were used, a strip inside the board 101 would correspond to the conductor 105. The microstrip 111 continues from the connecting point of the resistor 121 onward as a narrower microstrip 131, which forms an impedance $Z_o$ with the board 101 and the ground plane 102. The microstrip 131 leads to the first output out1. The strips 112, 113 and 114 continue in the same way. They lead to the outputs out2, out3 and out4. The structure has the drawback that the connecting of the discrete components requires joints on the board, which means reduced reliability.

A structure corresponding to that shown in FIG. 1 can also be implemented by thin-film technology, whereby the resistive components are formed by sputtering, for example. A structure like this has the drawback that its costs, including encapsulation, are relatively high.

A simple directional coupler can be made by arranging another conductor in parallel with the signal strip conductor on the surface of a dielectric board, the other side of which acts as the ground plane. This structure has the drawback that its directional properties are relatively poor. A structure with better directional properties is obtained when both strips are arranged inside a dielectric board, both sides of which are ground planes. A tighter electromagnetic coupling compared to both structures is obtained e.g. by the so-called Lange coupler. FIG. 2 shows the Lange coupler in the prior art form. It has three conductor areas on the surface of a dielectric board. The first conductor area comprises a quarter-wave long, strip-like center conductor 201, a first strip extension 202 and a second strip extension 203. The extensions 202 and 203 reach from the opposite ends of the structure to the middle of the center conductor 201. The ends of the extensions are connected with conductor wires 221 and 222 to the midpoint of the center conductor. The second conductor area comprises a quarter-wave long strip conductor 211, which runs beside the center conductor, between it and the first extension 202. The third conductor area comprises a quarter-wave long strip conductor 212, which runs beside the center conductor, between it and the second extension 203. The center conductor 201 remains between the conductor strips 211 and 212. The conductor strips 211 and 212 are connected to each other with conductor wires 223 and 224 at the opposite ends of the structure. The structure is a four-port. Port 1 is linked with the end of the conductor 211, which is not between the extension 202 and the center conductor. Port 2 is linked with the end of the conductor 212, which is not between the extension 203 and the center conductor. Port 3 is linked with the branching point of the center conductor and the extension 203. Port 4 is linked with the branching point of the center conductor and the extension 202. Each port also includes the ground plane, which is not drawn in FIG. 2. The signal is fed to port 1, for example. Then most of the energy fed in comes out from port 2. Part of the incoming energy is transferred to port 3. This part is relatively small. Instead, hardly any energy is transferred to port 4. The drawback of the Lange coupler is the joints required by the jumper wires, which mean reduced reliability and an increase in manufacturing costs. In addition, the surface area required is relatively large, because the conductor strips are placed on the same level.

SUMMARY OF THE INVENTION

The purpose of the invention is to reduce the above mentioned drawbacks of the prior art. The means according to the invention is characterized in what is set forth in the independent claim. Some preferred embodiments of the invention are presented in the dependent claims.

The basic idea of the invention is the following: All parts of the dividing means are integrated into a monolithic structure in an insulating material, preferably multilayer ceramics. The transmission line strips and other conductors are formed by printing conductive material on the outer surface of the ceramic piece and in its interlayers, when required. The conductors between the surfaces are formed by filling the hole made through the layer or layers with conducting material. The resistive components parallel with and between the surfaces are formed in a similar manner.

The invention has the advantage that the dividing means becomes reliable. Another advantage of the invention is the fact that the manufacturing costs of the dividing means are relatively low. Both of these advantages are due to the monolithic structure, in which no wire joints are needed. Yet another advantage of the invention is the fact that the structure according to it can be fitted in a relatively small space, because structural parts can be placed on top of each other in the insulating material, and also vertically inside the board. Furthermore, the invention has the advantage that the transmission lines, in which the TEM (transversal electromagnetic) wave, which is advantageous for the coupling, propagates, can be manufactured in a relatively simple manner.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be described in more detail. Reference will be made to the accompanying drawings, in which.

DETAILED DESCRIPTION OF THE PRESENTLY PREFERRED EMBODIMENTS

Figure 1:
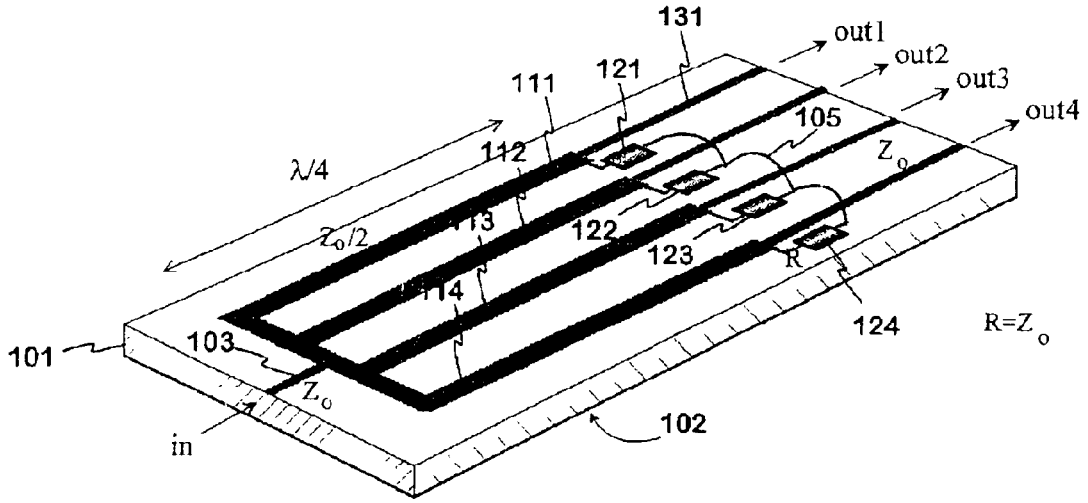
Fig. 1 PRIOR ART
FIG. 1 shows an example of a prior art divider.
Figure 2:
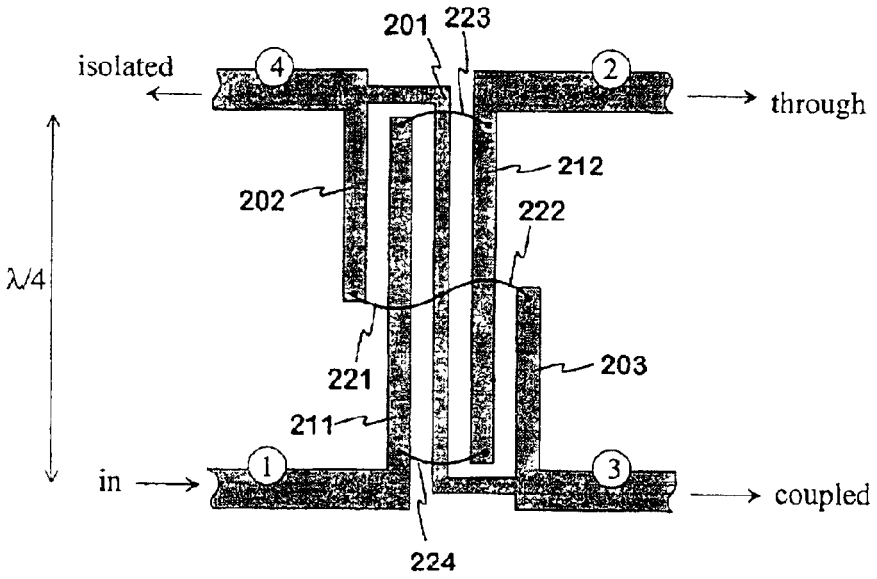
Fig. 2 PRIOR ART
FIG. 2 shows an example of a prior art coupler.

FIGS. 1 and 2 were already described in connection with the description of the prior art.

Figure 3A:
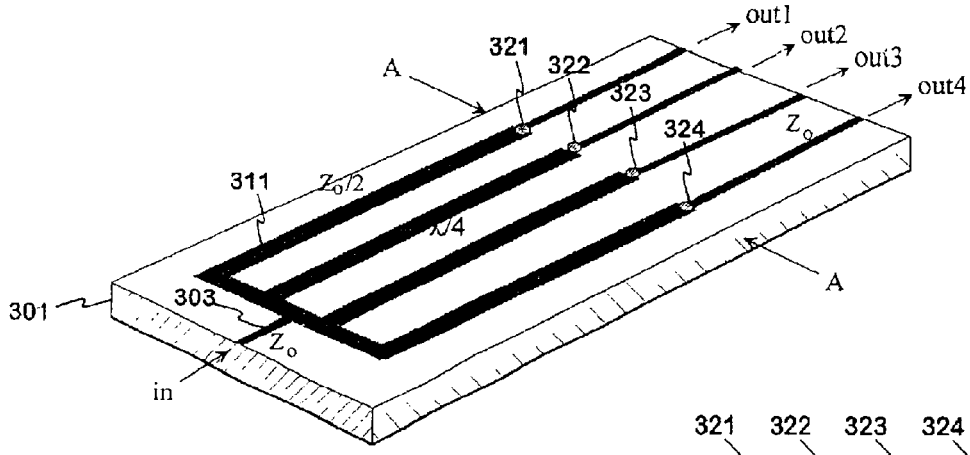
FIG. 3*a* shows an example of a divider according to the invention.
Figure 3B:
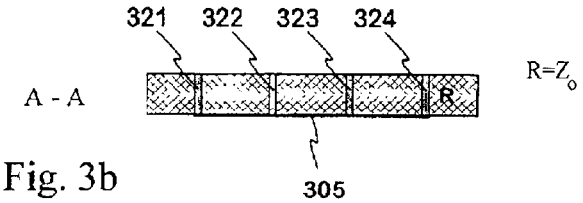
FIG. 3*b* shows a cross-section of the structure of FIG. 3*a,*

FIGS. 3*a* and 3*b* show an example of a divider according to the invention. It has corresponding structural parts as the structure of FIG. 1, i.e. it is a four-branch Wilkinson divider. In FIG. 3*a*, the divider is drawn in a similar manner as in FIG. 1, and FIG. 3*b* shows the section A—A at the resistive structural parts 321, 322, 323 and 324. In this case, the dielectric board 301 is ceramic. The essential difference compared to FIG. 1 is the implementation of resistive structural parts included in the divider. According to the section A—A, the resistive structural parts 321, 322, 323 and 324 are composed of resistive masses that solidly fill the holes in the ceramic structure. Such a through hole in the board is called 'via' in this specification. The lower ends of the resistive parts are combined with a conductor 305 on the lower surface of the board 301. The conductor 305, as well as the ground plane insulated from the conductor 305 on the lower surface, and the conductors on the upper surface of the board are formed with the printing technique in this example. In this way, the structure becomes a monolithic piece. Compared to the structure of FIG. 1, reliability increases and manufacturing costs are reduced, because there are no discrete components and jumper wires. In this description and especially in the claims, a monolithic piece means a solid body, in which the removal of a structural part of the body would essentially break this body. For example, an electronic circuit integrated into silicon is a monolithic piece. In contrast, a board on which a discrete component has been glued, or a conductor wire has been soldered or welded, is not a monolithic piece, because a joint like this can be dismantled without breaking the piece and be made again.

Figure 4A:
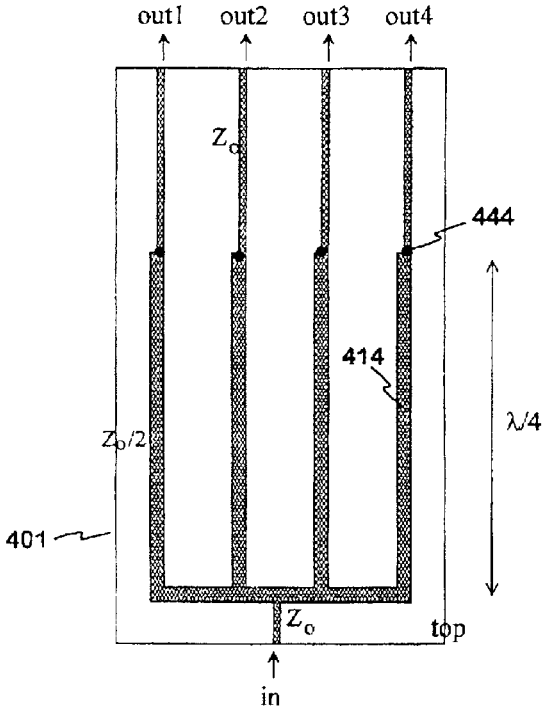
FIG. 4*a* shows another example of a divider according to the invention from the top.
Figure 4B:
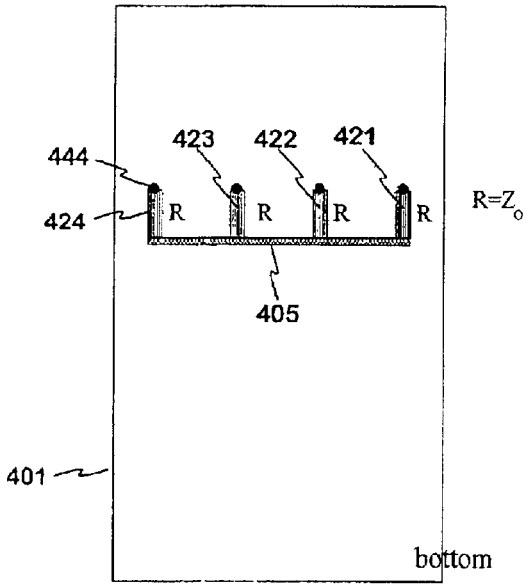
FIG. 4*b* shows the divider of FIG. 4*a* from below.

FIGS. 4*a* and 4*b* show another example of an implementation according to the invention, corresponding to FIG. 1. FIG. 4*a* shows the structure from above, and FIG. 4*b* from below. The difference compared to the implementation of FIG. 3 is the fact that the resistive structural parts of the Wilkinson divider are formed by printing on the lower surface of the ceramic board 401. On the surface of the board there are, according to FIG. 4*b*, the resistive parts 421, 422, 423 and 424 and a conductor 405, which connects together the ends of these parts. The other ends of the resistive parts, which are upper in the figure, are connected to the ends of the quarter-wave conductors of the divider by a similar "via" technique, by which the resistive parts are formed in FIG. 3. In FIGS. 4*a* and 4*b*, the holes have been filled with conductor material. For example, via 444 is a conductor, which connects the resistive part 424 to the conductor 414 of the transmission line. The ground plane of the transmission lines, which is in the interlayer of the ceramic board, is not shown in FIGS. 4*a* and 4*b*.

The dividing means described above was a Wilkinson divider, which distributes high-frequency energy to several transmission paths. It could also be a means used in an inverse manner, a Wilkinson combiner. In addition, the manner of implementation need not be according to Wilkinson in either case.

Figure 5:
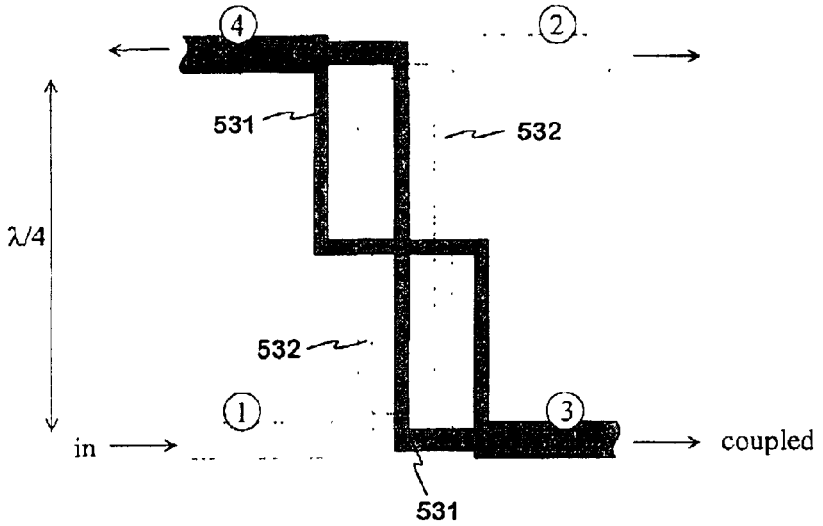
FIG. 5 shows an example of a coupler according to the invention.

FIG. 5 shows an example of an implementation of the invention corresponding to the Lange coupler shown in FIG. 2. The idea is that the conductor patterns required by the coupler are placed in different layers of the multilayer board to prevent jumper wires. FIG. 5 shows a continuous conductor pattern 531, which is situated in a layer of the board, and a continuous conductor pattern 532 situated in lower layer of the board compared to the previous one. When compared to FIG. 2, the conductor pattern 531 replaces the strip conductors 201, 202 and 203 and the conductor wires 221 and 222 with their joints. The conductor pattern 532 again replaces the strip conductors 211 and 212 and the conductor wires 223 and 224 with their joints. FIG. 5 shows the corresponding ports 1 to 4 as in FIG. 2. The ground plane, which is needed both above and below the structure shown in the figure, is not shown. The use of two ground planes entails the extra feature that the electromagnetic field created in the lines is of the TEM form, which is advantageous for the efficiency of the directional coupling. The structure described above can be manufactured besides by using a ceramic board and printing technique also by using an ordinary multilayer circuit board, for example.

Figure 6A:
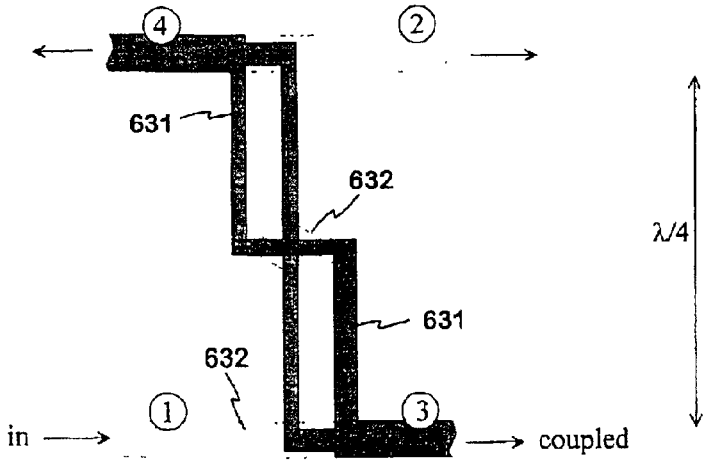
FIG. 6*a* shows another example of a coupler according to the invention.
Figure 6B:
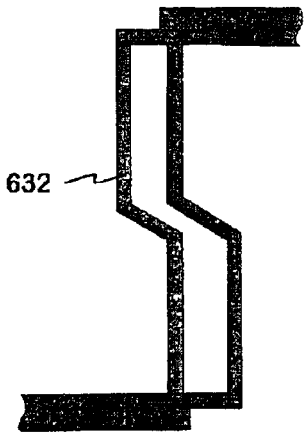
FIG 6*b* shows the second main part of the coupler shown in FIG. 6*a*.

When the multilayer technique is used in the above described manner, the Lange coupler and the corresponding circuits can be implemented as a monolithic structure without jumper wires. Another advantage of the multilayer technique is the fact that the surface area required by the structure can be reduced as compared to the situation that the whole circuit would be on the same level. This is shown by FIGS. 6*a* and 6*b*. In FIG. 6*a*, the conductor pattern 631 corresponds to the conductor pattern 531 in FIG. 5, and the conductor pattern 632 corresponds to the conductor pattern 532 in FIG. 5. The difference compared to FIG. 5 is the fact that the conductors of different layers are placed on a narrower area and on top of each other. When the conductors are on top of each other, a tighter coupling can be accomplished between them.

Some solutions according to the invention have been described above. However, the invention is not limited to these solutions only. The energy divider/combiner can be of the T-junction type, for example. The shape and mutual location of two strips, between which there is an electromagnetic coupling, can vary substantially. The structure can be a so-called hybrid, in which case it has a closed circuit composed of quarter-wave long parts. The inventive idea can be applied in many ways within the scope defined by the independent claim.

Thus, while there have been shown and described and pointed out fundamental novel features of the present invention as applied to preferred embodiments thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A handling means of high-frequency energy, which means comprises a multilayer dielectric board having at least two strip conductors, between which there is an electromagnetic coupling, wherein the handling means forms a monolithic piece, and at least two conductors of said strip conductors are located in different interlayers of the multilayer board on top of each other to arrange said electromagnetic coupling.

2. A handling means according to claim 1, wherein on two surfaces of said multilayer board there is a conductive plane so that said strip conductors are in the layers between these planes to form transmission lines suitable for TEM waves.

3. A handling means according to claim 2, being a Lange coupler.

4. A handling means according to claim 1, being a Wilkinson divider.

5. A handling means according to claim 1, being a Wilkinson combiner.

6. A high frequency splitter/combiner comprising:

a board having two opposing planar sides;

a plurality of strip conductors arranged on one side of said board and coupled to each other;

a plurality of resistive structural parts corresponding respectively to said plurality of strip conductors and arranged on the other side of said board, said board defining holes therethrough filled with conductive material, each of said holes connecting one of said plural strip conductor with a respective one of said plural resistive structural parts.

7. A high frequency splitter/combiner according to claim 6, wherein said board is ceramic, and said strip conductors have been processed on its surface.

8. A high frequency splitter/combiner according to claim 7, wherein each of said resistive structural parts is formed of said conductive material filling up a corresponding hole in the ceramic board.

9. A high frequency splitter/combiner according to claim 7, wherein each of said resistive structural parts is formed of material processed on the surface of the ceramic board and is in series with said conductive material filling up a corresponding bole in the ceramic board.

10. A high frequency splitter/combiner according to claim 8, being a Wilkinson divider.

11. A high frequency splitter/combiner according to claim 8, being a Wilkinson combiner.

* * * * *